US010051937B1

(12) United States Patent
Wenzel

(10) Patent No.: US 10,051,937 B1
(45) Date of Patent: Aug. 21, 2018

(54) SPRING-LOADED HAIR CLIP

(71) Applicant: Charlotte Wenzel, Port Charlotte, FL (US)

(72) Inventor: Charlotte Wenzel, Port Charlotte, FL (US)

( * ) Notice: Subject to any disclaimer, the term of this patent is extended or adjusted under 35 U.S.C. 154(b) by 210 days.

(21) Appl. No.: 15/156,482

(22) Filed: May 17, 2016

(51) Int. Cl.
*A45D 8/20* (2006.01)

(52) U.S. Cl.
CPC ..... *A45D 8/20* (2013.01)

(58) Field of Classification Search
CPC ..... A45D 8/20; A45D 8/24; A45D 8/30
See application file for complete search history.

(56) References Cited

U.S. PATENT DOCUMENTS

| | | | | |
|---|---|---|---|---|
| 5,769,101 | A | 6/1998 | Iwata | |
| 6,257,251 | B1 | 7/2001 | Burleson | |
| 6,311,699 | B1 | 11/2001 | Horman | |
| 7,766,020 | B2 | 8/2010 | Chininis | |
| D719,297 | S | 12/2014 | Hsu | |
| 2002/0162564 | A1 | 11/2002 | Head | |
| 2004/0065341 | A1 | 4/2004 | La Fauci | |
| 2004/0177861 | A1* | 9/2004 | Rogers | A45D 8/22 132/277 |
| 2004/0226574 | A1* | 11/2004 | Winn | A45D 8/22 132/277 |
| 2008/0156342 | A1* | 7/2008 | Chininis | A45D 8/20 132/277 |
| 2009/0272397 | A1* | 11/2009 | Defenbaugh | A45D 8/20 132/277 |
| 2011/0120490 | A1* | 5/2011 | King | A45D 8/24 132/210 |

FOREIGN PATENT DOCUMENTS

| | | | |
|---|---|---|---|
| WO | 2013033045 | A1 | 3/2013 |

* cited by examiner

*Primary Examiner* — Todd E Manahan
*Assistant Examiner* — Brianne Kalach

(57) ABSTRACT

The spring-loaded hair clip is a spring-loaded holding device that is adapted for use with hair. The spring-loaded hair clip is a personal grooming device that holds hair in position. A portion of the spring-loaded hair clip is coated in an elastomeric material for comfort and to prevent damage to the hair. An extension side plate extends down between one of the two jaws. A spring-loaded plunger biases the hair clip in a closed position.

4 Claims, 4 Drawing Sheets

SPRING-LOADED HAIR CLIP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hair dressing and shaving equipment, more specifically, a hair holding device.

SUMMARY OF INVENTION

The spring-loaded hair clip is a spring-loaded holding device that is adapted for use with hair. The spring-loaded hair clip is a personal grooming device that holds hair in position. A portion of the spring-loaded hair clip is coated in an elastomeric material for comfort and to prevent damage to the hair. An extension side plate extends down between one of the two jaws. A spring-loaded plunger biases the hair clip in a closed position.

These together with additional objects, features and advantages of the spring-loaded hair clip will be readily apparent to those of ordinary skill in the art upon reading the following detailed description of the presently preferred, but nonetheless illustrative, embodiments when taken in conjunction with the accompanying drawings.

In this respect, before explaining the current embodiments of the spring-loaded hair clip in detail, it is to be understood that the spring-loaded hair clip is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the spring-loaded hair clip.

It is therefore important that the claims be regarded as including such equivalent construction insofar as they do not depart from the spirit and scope of the spring-loaded hair clip. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
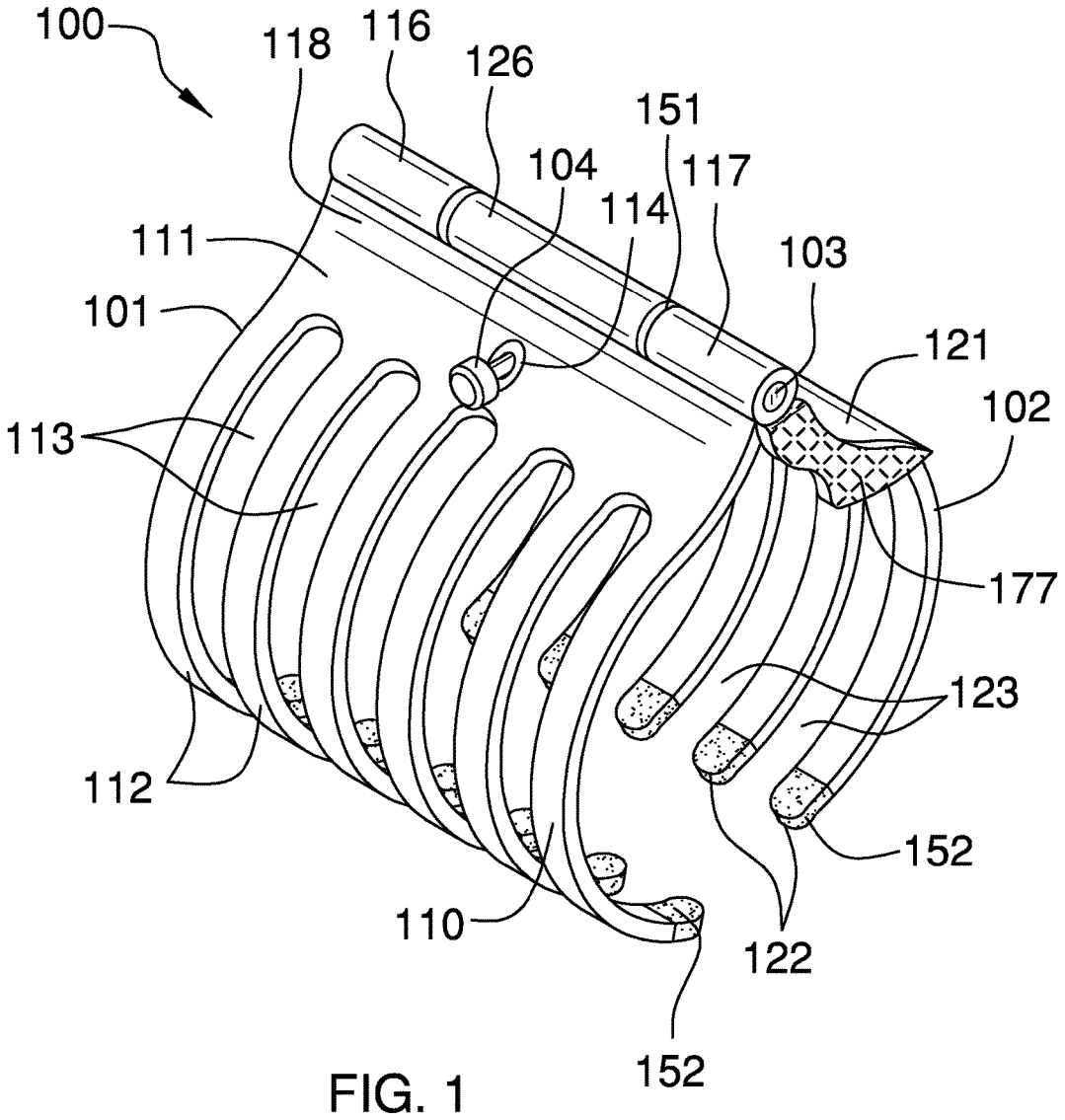
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The spring-loaded hair clip 100 (hereinafter invention) comprises a first jaw 101, a second jaw 102, a hinge pin 103, and a lock and release mechanism 104. The invention 100 is a spring-loaded holding device that is adapted for use with hair. The invention 100 is a personal grooming device that holds hair in position. Portions of the invention 100 are coated in an elastomeric material 152 for comfort and to prevent damage to the hair.

Figure 6:
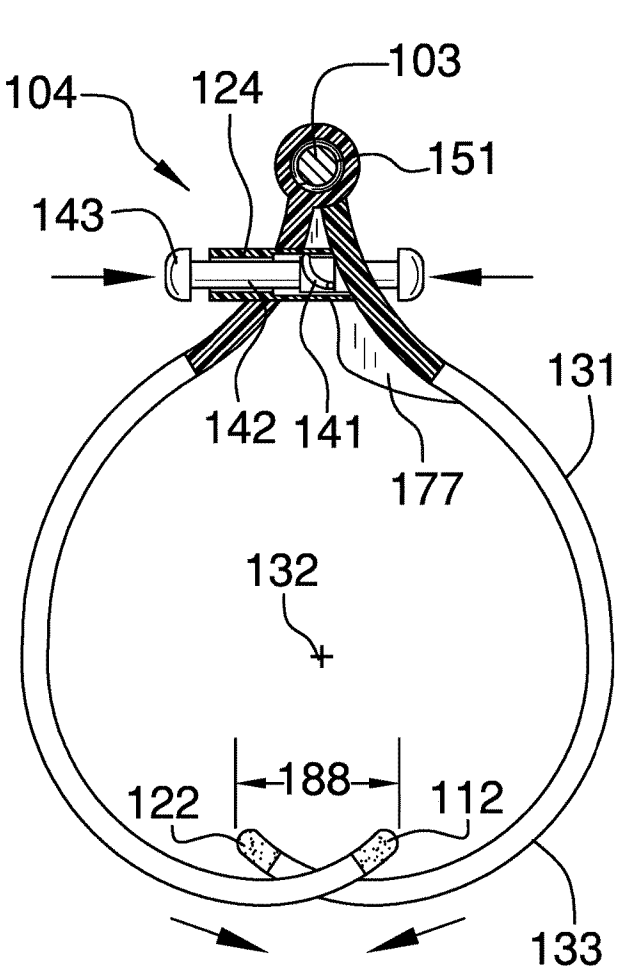
FIG. 6 is a cross-sectional view of an embodiment of the disclosure across 5-5 in FIG. 3.
Figure 5:
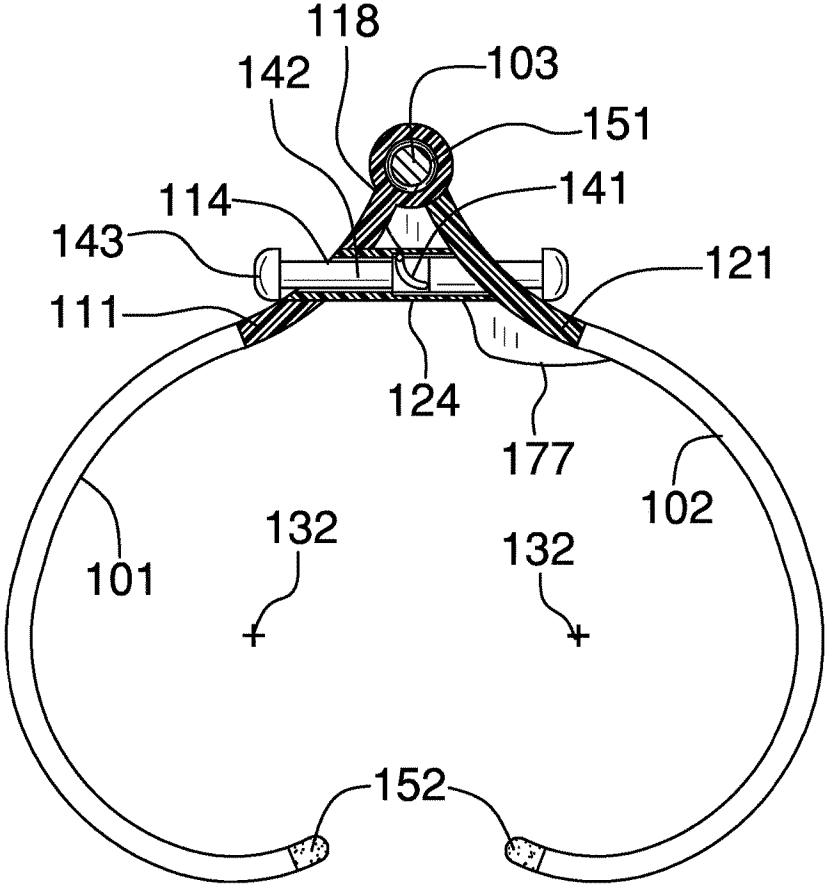
FIG. 5 is a cross-sectional view of an embodiment of the disclosure across 5-5 in FIG. 3.

As shown most clearly in FIGS. 1, 2, 5 and 6 the first jaw 101 and the second jaw 102 are joined together using the hinge pin 103 to form a cylindrical structure 131. The first jaw 101 and the second jaw 102 can move relative to each other using the hinge pin 103 as a pivot point. As shown in FIGS. 5 and 6, the relative motion of the first jaw 101 and the second jaw 102 can be used to open and close the cylindrical structure 131. The opening and closing of the cylindrical structure 131 allows for the insertion of hair into and the removal of hair from the cylindrical structure 131. The lock and release mechanism 104 is a spring-loaded mechanism that is used to open and close the cylindrical structure 131.

The first jaw 101 forms a semi-cylindrical structure 131 that is further defined with a center axis 132. The first jaw 101 further comprises a first surface 110 that is further defined by a first base 111 and a first plurality of teeth 112. The contour of the first surface 110 follows the face of the semi-cylindrical structure 131. The first base 111 is the solid and continuous portion of the first surface 110. The first plurality of teeth 112 is further defined with a first plurality of diastema 113. The number of diastema contained in the first plurality of diastema 113 will be one less than the number of teeth contained in the first plurality of teeth 112.

Figure 2:
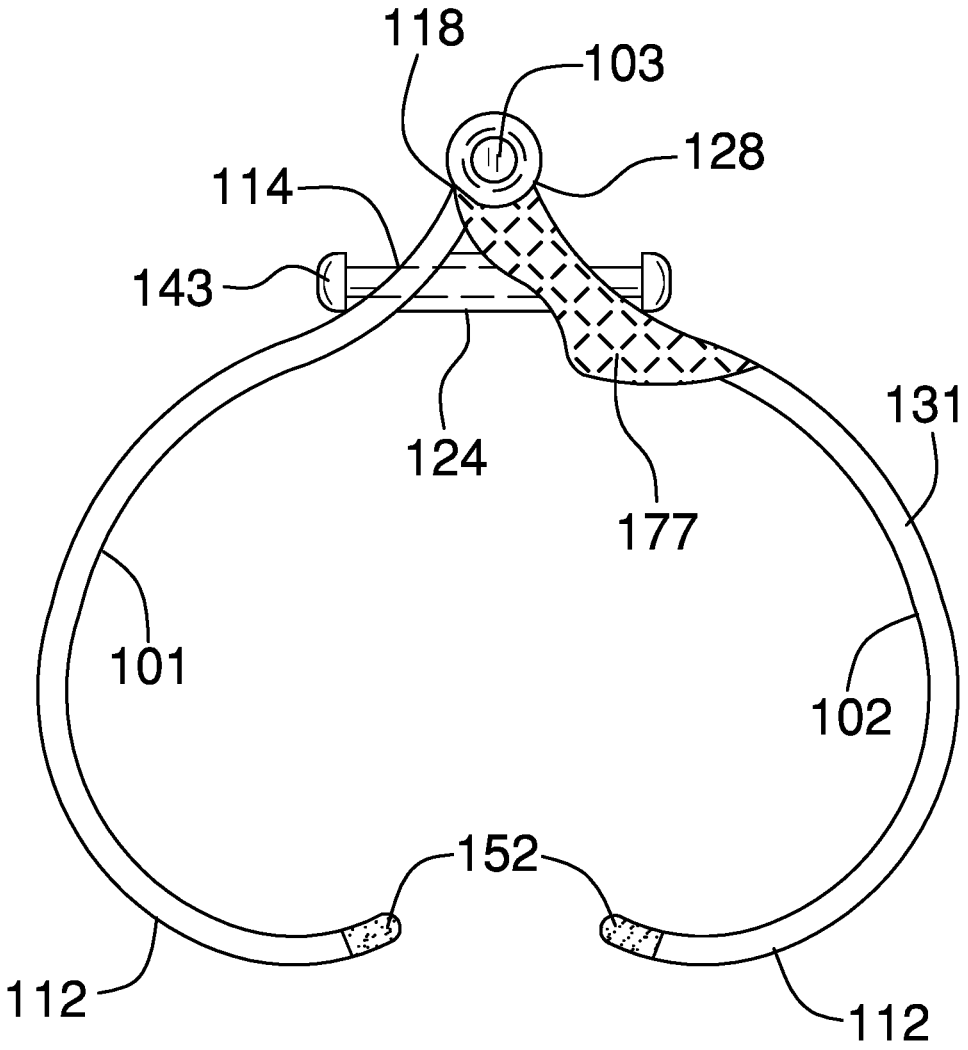
FIG. 2 is a side view of an embodiment of the disclosure.
Figure 3:
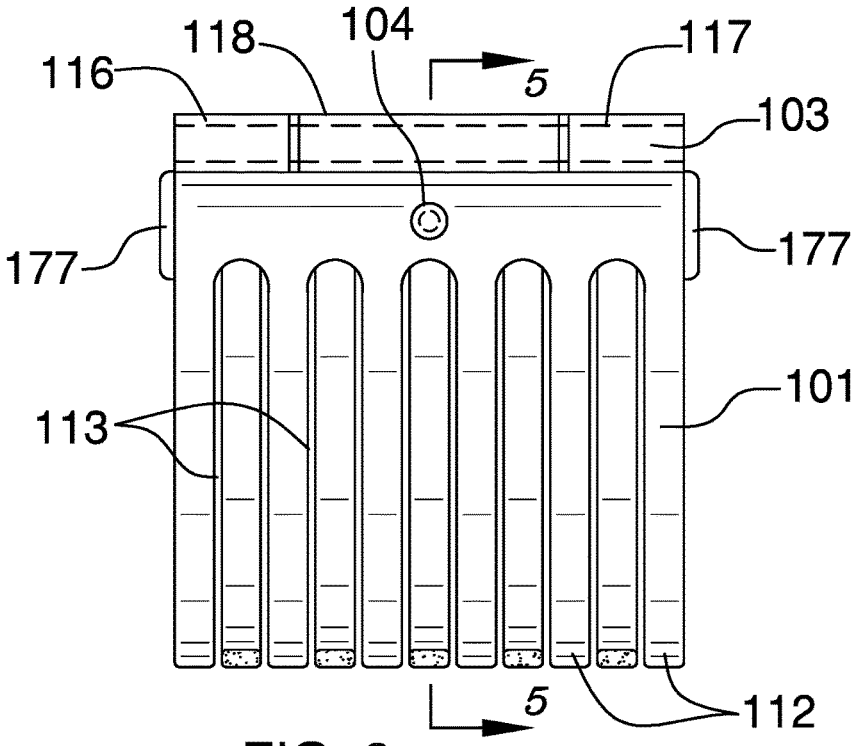
FIG. 3 is a front view of an embodiment of the disclosure.
Figure 4:
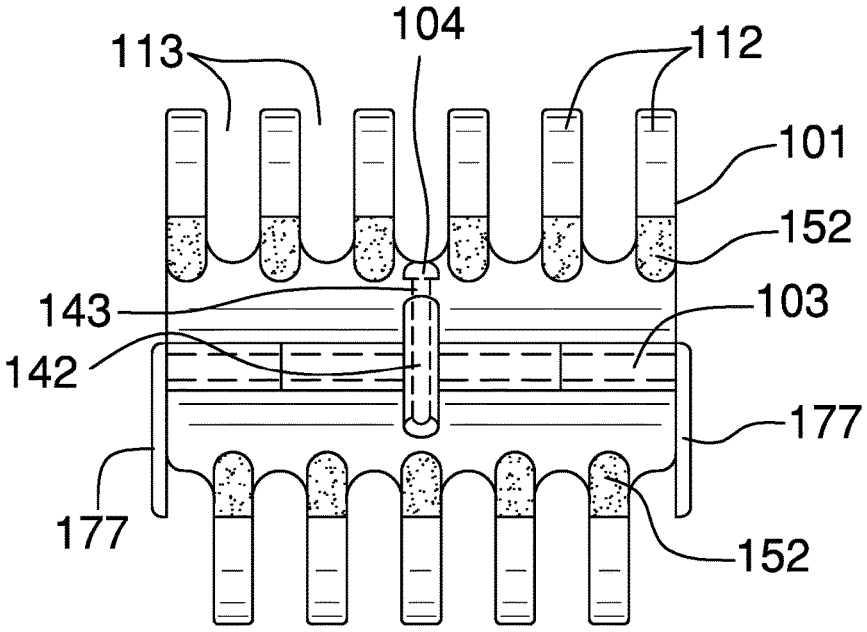
FIG. 4 is a bottom view of an embodiment of the disclosure.

As shown most clearly in FIGS. 1 through 3, each of the first plurality of teeth 112 project away from the first base 111 in a manner that maintains the first surface 110 of the semi-cylindrical structure 131 of the first jaw 101. Each of the first plurality of diastema 113 is a space positioned between any first tooth selected from the first plurality of teeth 112 and a second tooth selected from the first plurality of teeth 112 that is adjacent to the selected first tooth.

The second jaw 102 forms a semi cylindrical structure 131 that is further defined with a center axis 132. When the first jaw 101 and the second jaw 102 are joined together with the hinge pin 103 and placed in the closed position 133, the center axis 132 of the first jaw 101 and the center axis 132 of the second jaw 102 are aligned. When the first jaw 101 and the second jaw 102 are rotated relative to each other to provide an opening for the insertion of hair, the center axis 132 of the first jaw 101 and the center axis 132 of the second jaw 102 will become offset, but will remain parallel to each other until the first jaw 101 and the second jaw 102 return to the closed position 133. The second jaw 102 further comprises a second surface 120 that is further defined by a second base 121 and a second plurality of teeth 122. When closed, the second plurality of teeth 122 interlock with the first plurality of teeth 112 (see FIG. 6). The interlocking of the first plurality of teeth 112 with the second plurality of teeth 122 provides an overlap 188

The contour of a second surface 120 follows the face of the semi-cylindrical structure 131. The second base 121 is the solid and continuous portion of the second surface 120. The second plurality of teeth 122 is further defined with a second plurality of diastema 123. The number of diastema contained in the second plurality of diastema 123 will be one less than the number of teeth contained in the second plurality of teeth 122.

As shown most clearly in FIGS. 1 through 3, each of the second plurality of teeth 122 project away from the second base in a manner that maintains the surface of the semi-cylindrical structure 131 of the second jaw 102. Each of the second plurality of diastema 123 is a space positioned any third tooth selected from the second plurality of teeth 122 and a fourth tooth selected from the second plurality of teeth 122 that is adjacent to the selected third tooth.

As shown and identified most clearly in FIGS. 1 and 3, the first jaw 101 is further defined with a first edge 118 which is formed along the first base 111. A first hinge channel 116 and a second hinge channel 117 are formed along the first edge 118. The first hinge channel 116 and the second hinge channel 117 are right cylindrical tubes. The second jaw 102 is further defined with a second edge 128, which is formed along the second base 121. A third hinge channel 126 is formed along the second edge 128. The third hinge channel 126 is a right cylindrical tube. The third hinge channel 126 is sized and positioned on the second edge 128 such that the third hinge channel 126 will fit and align between the first hinge channel 116 and the second hinge channel 117. The inner diameter of the tube of the first hinge channel 116 is identical to the inner diameter of the tube of the third hinge channel 126, which is identical to the inner diameter of the tube of the second hinge channel 117.

When the first hinge channel 116, the second hinge channel 117 and the third hinge channel 126 are positioned and aligned the first jaw 101 and the second jaw 102 are held together using the hinge pin 103. The hinge pin 103 is a right cylindrical shaft with an outer diameter that is less than the inner diameter of the first hinge channel 116, the second hinge channel 117, and the third hinge channel 126. Final assembly of the first jaw 101 and the second jaw 102 requires the hinge pin 103 to be inserted through the first hinge channel 116, the second hinge channel 117 and the third hinge channel 126.

The first base 111 is further formed with an extension aperture 114. The second base 121 is further formed with an extension channel 124. The extension channel 124 is a rigid hollow tube that projects away from the second base 121 towards the first base 111 while the invention 100 is in the closed position 133. The extension channel 124 will fit through the extension aperture 114. The extension aperture 114 is a port that is positioned on the first base 111 such that when the first jaw 101 and the second jaw 102 are assembled the extension channel 124 will fit through the extension aperture 114. Because the relative rotation of the first jaw 101 and the second jaw 102 around the hinge pin 103 is non-linear the extension aperture 114 is sized such that the extension channel 124 will not touch the perimeter of the extension aperture 114 at any point in the relative rotation of the first jaw 101 and the second jaw 102.

The lock and release mechanism 104 comprises a physical attachment to the first base 111 with a spring 141, an extension shaft 142 and a plunger 143. The spring 141 and the extension shaft 142 are sized such that they can be inserted into the extension channel 124. The lock and release mechanism 104 operates in the same manner as a retractable pen such that when the plunger 143 is depressed, the extension shaft 142 is pressed into the extension channel 124 pressing against the second base 121 such that the relative position of the first jaw 101 and the second jaw 102 are changed effectively moving the invention 100 out of the closed position 133. The plunger 143 is then "clicked" into position holding the invention 100 in position. The spring 141 is a helical coil compression spring that is compressed when the extension shaft 142 is pressed into the extension channel 124.

When the plunger 143 is "clicked" a second time, the energy stored in the spring 141 is released pushing the extension shaft 142 away from the second base 121 thus returning the invention 100 into the closed position 133. Methods to create such a lock and release mechanism 104 are well known in the art and are commonly used in retractable pens.

In the first potential embodiment of the disclosure, as best shown in FIGS. 5 and 6, a torsion spring 151 is added to the invention 100 to assist in returning the invention 100 to the closed position 133. An extension plate 177 is added on either side of the second jaw 102. The extension plate 177 are provided on either side of the second jaw 102, and do not interfere with the rotational movement of the first jaw 101 relative to the second jaw 102.

To use the invention 100, the plunger 143 is depressed to move the invention 100 out of the closed position 133. Hair is then placed between the first jaw 101 and the second jaw 102. The invention 100 is then returned to the closed position 133 by depressing the plunger 143 a second time.

In the first potential embodiment of the disclosure, the first jaw 101 and the second jaw 102 are formed from molded plastic. Suitable plastics include, but are not limited to, polyethylene or polycarbonate. The hinge pin 103, the lock and release mechanism 104, and the torsion spring 151 are commercially available. In a second potential embodiment of the disclosure, the first plurality of teeth 112 and the second plurality of teeth 122 are partially coated in an elastomeric material 152 which increases the comfort of wearing the invention 100 and prevents damage to the hair. The use of polyurethane based elastomeric materials 152 is preferred.

The following definitions were used in this disclosure:

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Cylinder: As used in this disclosure, a cylinder is a geometric solid defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Diastema: As used in this disclosure, a diastema is the space between two teeth.

Elastic: As used in this disclosure, an elastic is a material or object that deforms when a force is applied to it and that is able to return to its original shape after the force is removed.

Elastomeric Material: As used in this disclosure, an elastomeric material is a material that deforms when a force is applied to it and that is able to return to its original shape after the force is removed.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Perimeter: As used in this disclosure, a perimeter is one or more curved or straight lines that bounds an enclosed area on a plane.

Pivot: As used in this disclosure, a pivot is a rod or shaft around which an object rotates or swings.

Tube: As used in this disclosure, a tube is a hollow cylindrical device with a first open end and a second open end that are often used for transporting liquids and gasses.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A device comprising:

a first jaw, a second jaw, a hinge pin, and a lock and release mechanism;

wherein the device is adapted for use with hair;

wherein the device is adapted for use in personal grooming;

wherein the device further comprises one or more springs;

wherein the device is adapted to attach to said hair;

wherein the first jaw and the second jaw are joined together using the hinge pin;

wherein the first jaw and the second jaw are joined together to form a cylindrical structure;

wherein the lock and release mechanism is a mechanism that is used to open and close the cylindrical structure;

wherein the first jaw forms a first semi-cylindrical structure that is further defined with a center axis;

wherein the first jaw further comprises a first surface that further comprises a first base and a first plurality of teeth;

wherein the contour of the first surface follows the face of the first semi-cylindrical structure;

wherein the second jaw forms a second semi-cylindrical structure that is further defined with a center axis;

wherein the second jaw further comprises a second surface that further comprises a second base and a second plurality of teeth;

wherein the contour of the second surface follows the face of the second semi-cylindrical structure;

wherein the first plurality of teeth is further defined with a first plurality of diastema;

wherein the second plurality of teeth is further defined with a second plurality of diastema;

wherein the number of diastema contained in the first plurality of diastema will be one less than the number of teeth contained in the first plurality of teeth;

wherein the number of diastema contained in the second plurality of diastema will be one less than the number of teeth contained in the second plurality of teeth;

wherein each of the first plurality of diastema is a space positioned between any first tooth selected from the first plurality of teeth and a second tooth selected from the first plurality of teeth that is adjacent to the selected first tooth;

wherein each of the second plurality of diastema is a space positioned between any third tooth selected from the second plurality of teeth and a fourth tooth selected from the second plurality of teeth that is adjacent to the selected second tooth;

wherein each of the first plurality of teeth project away from the first base in a manner that maintains the first surface of the first semi-cylindrical structure of the first jaw;

wherein each of the second plurality of teeth project away from the second base in a manner that maintains the second surface of the second semi-cylindrical structure of the second jaw;

wherein upon closing of the first jaw and the second jaw, the second plurality of teeth interlock with the first plurality of teeth;

wherein the first jaw is further defined with a first edge which is formed along the first base;

wherein the second jaw is further defined with a second edge which is formed along the second base;

wherein a first hinge channel and a second hinge channel are formed along the first edge;

wherein a third hinge channel is formed along the second edge;

wherein the first hinge channel is a right cylindrical tube;

wherein the second hinge channel is a right cylindrical tube;

wherein the third hinge channel is a right cylindrical tube;

wherein the third hinge channel is sized and positioned on the second edge such that the third hinge channel will fit and align between the first hinge channel and the second hinge channel;

wherein the hinge pin is a right cylindrical shaft;

wherein the inner diameter of the tube of the first hinge channel is identical to the inner diameter of the tube of the third hinge channel, which is identical to the inner diameter of the tube of the second hinge channel;

wherein the hinge pin has an outer diameter that is less than the inner diameter of the first hinge channel, the second hinge channel, and the third hinge channel;

wherein the assembly of the first jaw and the second jaw requires the hinge pin to be inserted through the first hinge channel, the second hinge channel and the third hinge channel;

wherein the first base is further formed with an extension aperture;

wherein the second base is further formed with an extension channel;

wherein the extension channel is a rigid hollow tube that projects away from the second base towards the first base while the device is in the closed position;

wherein the position of the extension channel and the span of the center axis of the extension channel is such that the extension channel will fit through the extension aperture;

wherein the lock and release mechanism comprises a physical attachment to the first base;

wherein the lock and release mechanism further comprises a spring and an extension shaft;

wherein the spring and the extension shaft are sized such that they can be inserted into the extension channel.

2. The device according to claim 1 wherein the spring is a helical coil compression spring that is compressed when the extension shaft is pressed into the extension channel.

3. The device according to claim 2 wherein the device further comprises a torsion spring.

4. The device according to claim 3 wherein the first plurality of teeth further comprises an elastomeric material;

wherein the second plurality of teeth further comprises an elastomeric material.

* * * * *